US010427272B2

(12) United States Patent
Xu et al.

(10) Patent No.: US 10,427,272 B2
(45) Date of Patent: Oct. 1, 2019

(54) ENDPOINT DETECTION WITH COMPENSATION FOR FILTERING

(71) Applicant: Applied Materials, Inc., Santa Clara, CA (US)

(72) Inventors: Kun Xu, Sunol, CA (US); Kevin Lin, Zhubei (TW); Ingemar Carlsson, Milpitas, CA (US); Shih-Haur Shen, Sunnyvale, CA (US); Tzu-Yu Liu, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 163 days.

(21) Appl. No.: 15/710,533

(22) Filed: Sep. 20, 2017

(65) Prior Publication Data

US 2018/0079052 A1 Mar. 22, 2018

Related U.S. Application Data

(60) Provisional application No. 62/397,840, filed on Sep. 21, 2016.

(51) Int. Cl.

| | |
|---|---|
| ***B24B 49/02*** | (2006.01) |
| ***B24B 47/10*** | (2006.01) |
| ***B24B 37/013*** | (2012.01) |
| ***B24B 37/10*** | (2012.01) |
| ***B24B 37/20*** | (2012.01) |
| ***B24B 37/22*** | (2012.01) |
| ***B24B 49/04*** | (2006.01) |

(52) U.S. Cl.

CPC ..... *B24B 49/02* (2013.01); *B24B 37/013* (2013.01); *B24B 37/105* (2013.01); *B24B 37/205* (2013.01); *B24B 37/22* (2013.01); *B24B 47/10* (2013.01); *B24B 49/04* (2013.01)

(58) Field of Classification Search

CPC ..... B24B 49/02; B24B 37/013; B24B 37/105; B24B 37/22; B24B 47/10; B24B 49/04

USPC ..... 451/5, 6, 41, 285–290

See application file for complete search history.

(56) References Cited

U.S. PATENT DOCUMENTS 5,097,633 A * 3/1992 Branton ..... B24C 7/0053 451/101
5,876,265 A * 3/1999 Kojima ..... B24B 37/013 438/691

(Continued)

FOREIGN PATENT DOCUMENTS

| | | |
|---|---|---|
| JP | 3887238 | 2/2007 |
| JP | 2011-249841 | 12/2011 |
| KR | 10-0584786 | 5/2006 |

OTHER PUBLICATIONS

International Search Report and Written Opinion in International Application No. PCT/US2017/052514, dated Feb. 9, 2018, 11 pages.

*Primary Examiner* — George B Nguyen
(74) *Attorney, Agent, or Firm* — Fish & Richardson P.C.

(57) ABSTRACT

A method of polishing includes polishing a layer of a substrate, monitoring the layer of the substrate with an in-situ monitoring system to generate signal that depends on a thickness of the layer, filtering the signal to generate a filtered signal, determining an adjusted threshold value from an original threshold value and a time delay value representative of time required for filtering the signal, and triggering a polishing endpoint when the filtered signal crosses the adjusted threshold value.

20 Claims, 6 Drawing Sheets

(56) References Cited

U.S. PATENT DOCUMENTS

| | | | | |
|---|---|---|---|---|
| 6,712,669 | B1 * | 3/2004 | Chang | B24B 37/013 451/5 |
| 6,924,641 | B1 | 8/2005 | Hanawa et al. | |
| 7,040,958 | B2 * | 5/2006 | Gan | B24B 37/013 451/41 |
| 7,764,377 | B2 | 7/2010 | Benvegnu et al. | |
| 9,117,751 | B2 | 8/2015 | Benvegnu et al. | |
| 2003/0036282 | A1 | 2/2003 | Usui et al. | |
| 2004/0254656 | A1 * | 12/2004 | Wagner | F02D 11/105 700/46 |
| 2004/0259470 | A1 | 12/2004 | Swedek et al. | |
| 2006/0037938 | A1 | 2/2006 | Yue | |
| 2013/0288572 | A1 | 10/2013 | Benvegnu | |
| 2014/0127971 | A1 | 5/2014 | Xu et al. | |
| 2015/0371913 | A1 * | 12/2015 | Lu | H01L 22/26 438/11 |
| 2016/0158908 | A1 | 6/2016 | Xu et al. | |

* cited by examiner

ENDPOINT DETECTION WITH COMPENSATION FOR FILTERING

CROSS-REFERENCE TO RELATED APPLICATIONS

This application claims priority to U.S. Application Ser. No. 62/397,840, filed Sep. 21, 2016, the entirety of which is incorporated by reference.

TECHNICAL FIELD

The present disclosure relates to monitoring using electromagnetic induction, e.g., eddy current monitoring, during chemical mechanical polishing.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization may be used to planarize a dielectric layer for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. A polishing liquid, such as slurry with abrasive particles, is supplied to the surface of the polishing pad.

During semiconductor processing, it may be important to determine one or more characteristics of the substrate or layers on the substrate. For example, it may be important to know the thickness of a conductive layer during a CMP process, so that the process may be terminated at the correct time. A number of methods may be used to determine substrate characteristics. For example, optical sensors may be used for in-situ monitoring of a substrate during chemical mechanical polishing. Alternately (or in addition), an eddy current sensing system may be used to induce eddy currents in a conductive region on the substrate to determine parameters such as the local thickness of the conductive region.

SUMMARY

In one aspect, a polishing system includes a platen to hold a polishing pad, a carrier head to hold a substrate against the polishing pad during polishing, an in-situ monitoring system to monitor the substrate during polishing and generate a signal that depends on a thickness of a layer of the substrate being polished, and a controller. The controller is configured to store an original threshold value and a time delay value representative of time required for filtering the signal, receive the signal from the in-situ monitoring system and filter the signal to generate a filtered signal, determine an adjusted threshold value from the original threshold value and the time delay value, and trigger a polishing endpoint when the filtered signal crosses the adjusted threshold value.

In another aspect, a computer program product may include a non-transitory computer-readable medium having instructions to cause a processor to receive from an in-situ monitoring system a signal that depends on a thickness of a layer of a substrate being polished, store an original threshold value and a time delay value representative of time required for filtering the signal, filter the signal to generate a filtered signal, determine an adjusted threshold value from the original threshold value and the time delay value, and trigger a polishing endpoint when the filtered signal crosses the adjusted threshold value.

In another aspect, a method of polishing includes polishing a layer of a substrate, monitoring the layer of the substrate with an in-situ monitoring system to generate signal that depends on a thickness of the layer, filtering the signal to generate a filtered signal, determining an adjusted threshold value from an original threshold value and a time delay value representative of time required for filtering the signal, and triggering a polishing endpoint when the filtered signal crosses the adjusted threshold value.

Implementations of any of the above aspect may include one or more of the following features.

A slope of the filtered signal may be determined. An adjustment for the threshold value may be determined by multiplying the time delay value by the slope. The adjusted threshold value VT' may be determined according to $VT'=VT-(\Delta T*R)$ where VT is the original threshold value, $\Delta T$ is the time delay value and R is the slope.

The signal may be filtered according to one or more filter parameters, and the time delay value may be determined based on the one or more filter parameters. The one or more filter parameters may include a number of measurements from the signal (e.g., the order of the filter) and/or a time period of the signal to be used to generate the filtered signal. The platen may be rotatable and the in-situ monitoring system comprises a sensor positioned in the platen such that the sensor intermittently sweeps below the substrate. The time period may be calculated from a measurement frequency and the number of measurements. The measurement frequency can be an inverse of a rotation rate of the platen.

The filtered signal may be generated by applying one or more of a running average or a notch filter to the signal. The in-situ monitoring system may be an eddy current monitoring system. The signal may be converted to a sequence of thickness measurements before the filtered signal is compared to the adjusted threshold valued. An adjusted thickness threshold can be calculated from an original thickness threshold, and the adjusted thickness threshold can be converted to a signal value threshold, and the filtered signal is compared to the signal value threshold.

Certain implementations can include one or more of the following advantages. Polishing can be halted more reliably at a target thickness, and water-to-wafer non-uniformity (WTWNU) can be reduced. Polishing can proceed at a higher rate, and throughput can be increased. Overpolishing and dishing can be reduced, and resistivity can be controlled more tightly from wafer-to-wafer.

The details of one or more implementations are set forth in the accompanying drawings and the description below. Other aspects, features and advantages will be apparent from the description and drawings, and from the claims.

BRIEF DESCRIPTION OF DRAWINGS

Like reference symbols in the various drawings indicate like elements.

DETAILED DESCRIPTION

A CMP system can use an eddy current monitoring system to generate a signal that depends on the thickness of an outermost metal layer on a substrate that is undergoing polishing. This signal can be compared to a threshold value, and endpoint detected when the signal reaches the threshold value. The signal from the eddy current monitoring system can include noise due, for example, to variations in layer thickness across the substrate as well as other sources such as lateral oscillation of the carrier head over the polishing pad. This noise can be reduced by application of a filter, eg., a notch filter, to the signal.

Many filtering techniques, including notch filters, require acquisition of signal values both before and after a nominal measurement time to generate a filtered value for the nominal measurement time. Due to the need to acquire signal values after the nominal measurement time, generation of the filtered value is delayed. If the polishing endpoint is detected based on a comparison of the filtered value to the threshold value, then by the time that the endpoint has been detected, the substrate will already have been polished past the target thickness. Even if the endpoint is detected based on a projection of a fitted function to the threshold value, the filter can introduce a delay.

By fitting a function to the sequence of signal values, and then adjusting the threshold value by an amount that will compensate for the time needed by the filter to acquire data, polishing can be halted closer to the target thickness.

Figure 1:
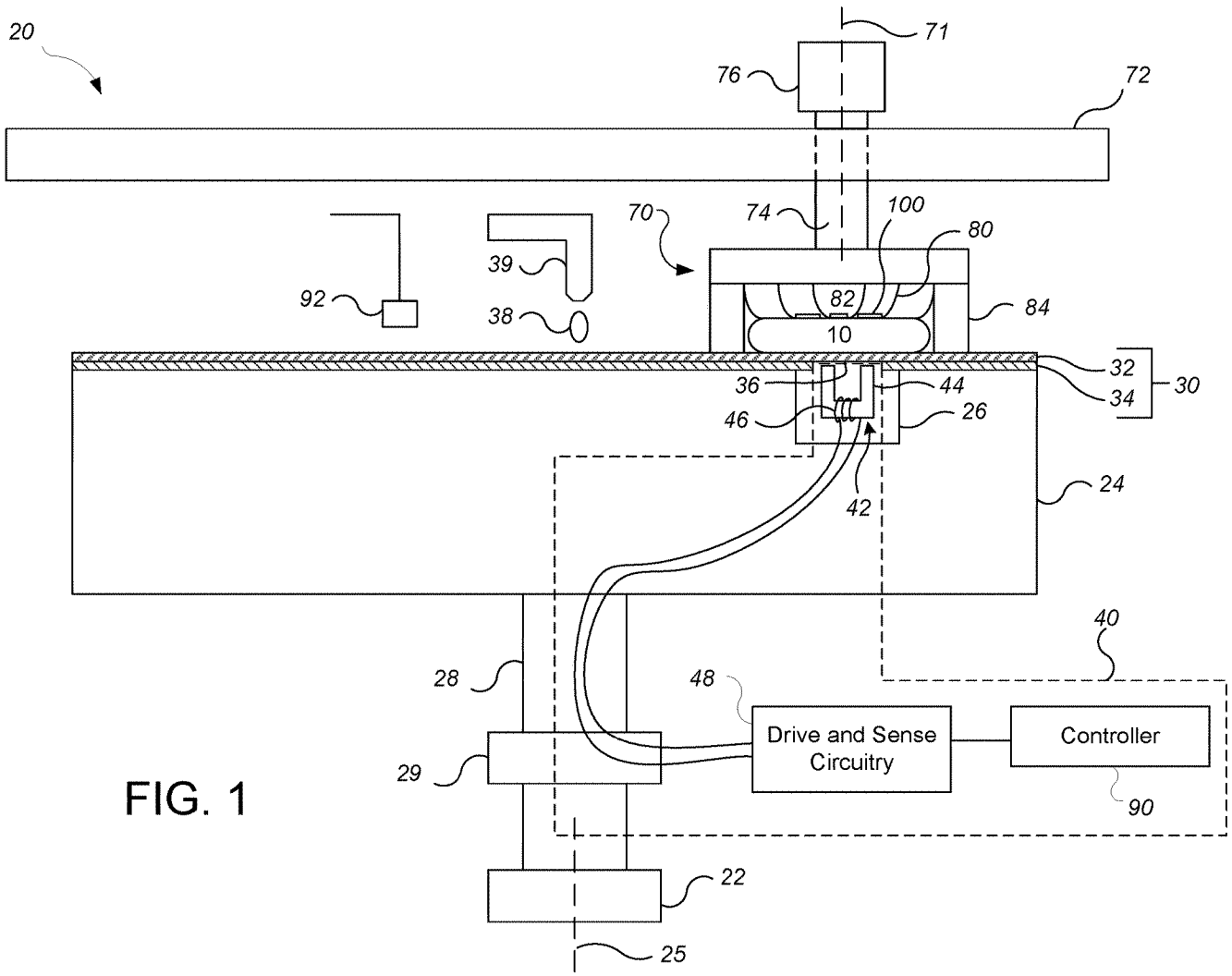
FIG. 1 is a schematic side view, partially cross-sectional, of a chemical mechanical polishing station that includes an electromagnetic induction monitoring system.
Figure 2:
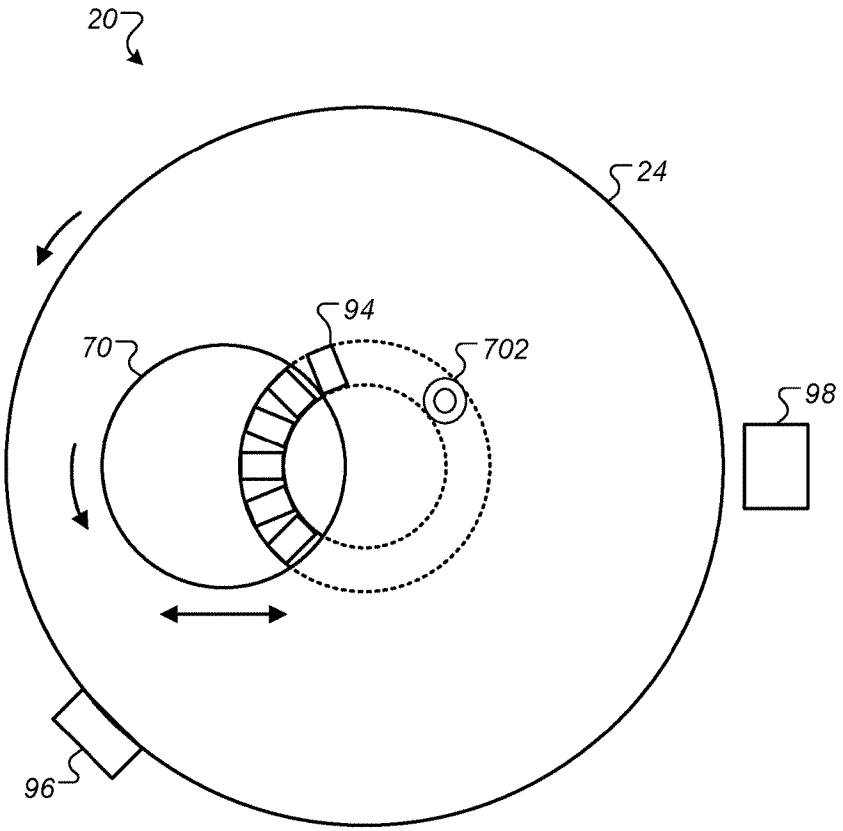
FIG. 2 is a schematic top view of the chemical mechanical polishing station of FIG. 1.

FIGS. 1 and 2 illustrate an example of a polishing station 20 of a chemical mechanical polishing apparatus. The polishing station 20 includes a rotatable disk-shaped platen 24 on which a polishing pad 30 is situated. The platen 24 is operable to rotate about an axis 25. For example, a motor 22 can turn a drive shaft 28 to rotate the platen 24. The polishing pad 30 can be a two-layer polishing pad with an outer layer 34 and a softer backing layer 32.

The polishing station 22 can include a supply port or a combined supply-rinse arm 39 to dispense a polishing liquid 38, such as slurry, onto the polishing pad 30. The polishing station 22 can include a pad conditioner apparatus with a conditioning disk to maintain the condition of the polishing pad.

The carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel or track 72; or by rotational oscillation of the carousel itself.

In operation, the platen is rotated about its central axis 25, and the carrier head is rotated about its central axis 71 and translated laterally across the top surface of the polishing pad 30. Where there are multiple carrier heads, each carrier head 70 can have independent control of its polishing parameters, for example each carrier head can independently control the pressure applied to each respective substrate.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

A recess 26 is formed in the platen 24, and optionally a thin section 36 can be formed in the polishing pad 30 overlying the recess 26. The recess 26 and thin pad section 36 can be positioned such that regardless of the translational position of the carrier head they pass beneath substrate 10 during a portion of the platen rotation. Assuming that the polishing pad 30 is a two-layer pad, the thin pad section 36 can be constructed by removing a portion of the backing layer 32. The thin section can optionally be optically transmissive, e.g., if an in-situ optical monitoring system is integrated into the platen 24.

An in-situ monitoring system 40 generates a sequence of values that depend on the thickness of a layer that is being polishing. In particular, the in-situ monitoring system 40 can be an electromagnetic induction monitoring system. The electromagnetic induction monitoring system can operate either by generation of eddy-current in a conductive layer or generation of current in a conductive loop. In operation, the polishing station 22 uses the monitoring system 40 to determine when the layer has been polished to a target depth.

The monitoring system 40 can include a sensor 42 installed in the recess 26 in the platen. The sensor 26 can include a magnetic core 44 positioned at least partially in the recess 26, and at least one coil 46 wound around the core 44. Drive and sense circuitry 48 is electrically connected to the coil 46. The drive and sense circuitry 48 generates a signal that can be sent to a controller 90. Although illustrated as outside the platen 24, some or all of the drive and sense circuitry 48 can be installed in the platen 24. A rotary coupler 29 can be used to electrically connect components in the rotatable platen, e.g., the coil 46, to components outside the platen, e.g., the drive and sense circuitry 48.

As the platen 24 rotates, the sensor 42 sweeps below the substrate 10. By sampling the signal from the circuitry 48 at a particular frequency, the circuitry 48 generates measurements at a sequence of sampling zones across the substrate 10. For each sweep, measurements at one or more of the sampling zones 94 can be selected or combined. Thus, over multiple sweeps, the selected or combined measurements provide the time-varying sequence of values.

The polishing station 20 can also include a position sensor 96 (see FIG. 2), such as an optical interrupter, to sense when the sensor 42 is underneath the substrate 10 and when the sensor 42 is off the substrate. For example, the position sensor 96 can be mounted at a fixed location opposite the carrier head 70. A flag 98 (see FIG. 2) can be attached to the periphery of the platen 24. The point of attachment and length of the flag 98 is selected so that it can signal the position sensor 96 when the sensor 42 sweeps underneath the substrate 10.

Alternately, the polishing station 20 can include an encoder to determine the angular position of the platen 24. The sensor can sweep underneath the substrate with each rotation of the platen.

A controller 90, e.g., a general purpose programmable digital computer, receives the sequence of values from the electromagnetic induction monitoring system 40. Since the sensor 42 sweeps beneath the substrate 10 with each rotation of the platen 24, information on the depth of the trenches is accumulated in-situ (once per platen rotation). The controller 90 can be programmed to sample measurements from the monitoring system 40 when the substrate 10 generally overlies the thin section 36 (as determined by the position sensor). As polishing progresses, the thickness of the layer changes, and the sampled signals vary with time. The measurements from the monitoring system can be displayed on an output device during polishing to permit the operator of the device to visually monitor the progress of the polishing operation.

In addition, the controller 90 can be programmed to divide the measurements from both the electromagnetic induction current monitoring system 40 from each sweep beneath the substrate into a plurality of sampling zones, to calculate the radial position of each sampling zone, and to sort the measurements into radial ranges.

Figure 3:
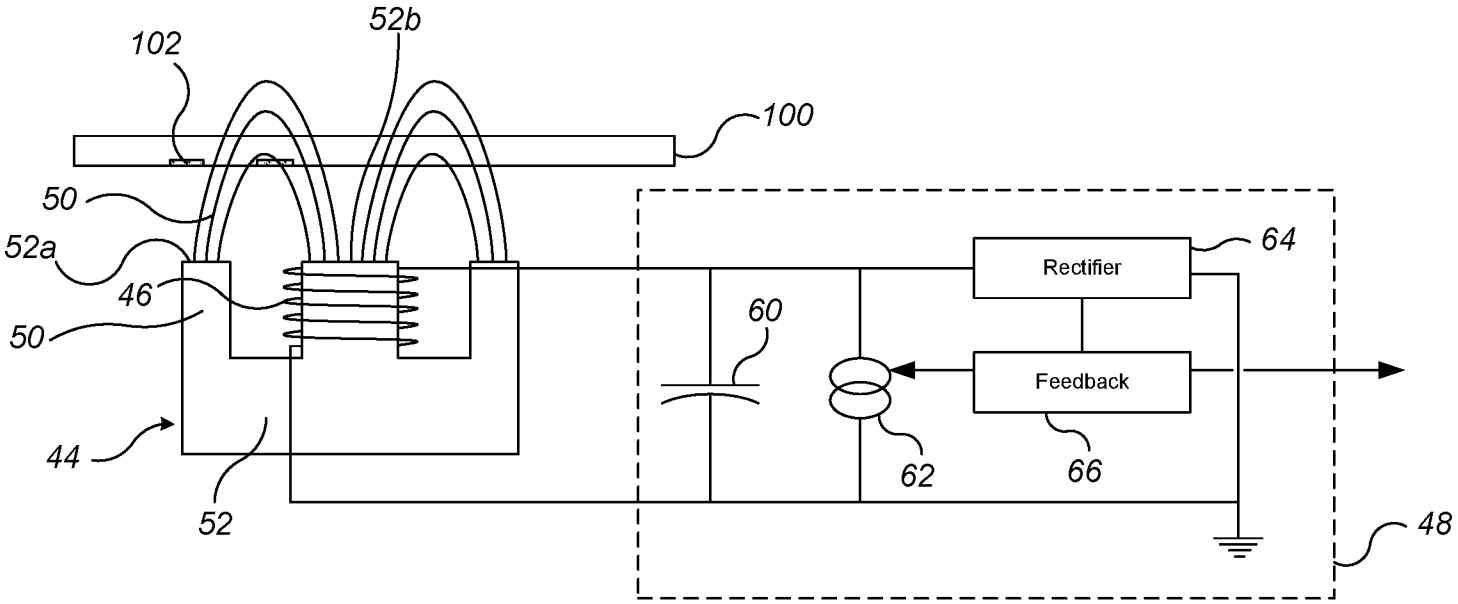
FIG. 3 is a schematic circuit diagram of a drive system for an electromagnetic induction monitoring system.

FIG. 3 illustrates an example of the drive and sense circuitry 48. The circuitry 48 applies an AC current to the coil 46, which generates a magnetic field 50 between two poles 52*a* and 52*b* of the core 44. The core 44 can include two (see FIG. 1) or three (see FIG. 3) prongs 50 extending in parallel from a back portion 52. Implementations with only one prong (and no back portion) are also possible. In operation, when the substrate 10 intermittently overlies the sensor 42, a portion of the magnetic field 50 extends into the substrate 10.

The circuitry 48 can include a capacitor 60 connected in parallel with the coil 46. Together the coil 46 and the capacitor 60 can form an LC resonant tank. In operation, a current generator 62 (e.g., a current generator based on a marginal oscillator circuit) drives the system at the resonant frequency of the LC tank circuit formed by the coil 46 (with inductance L) and the capacitor 60 (with capacitance C). The current generator 62 can be designed to maintain the peak to peak amplitude of the sinusoidal oscillation at a constant value. A time-dependent voltage with amplitude $V_0$ is rectified using a rectifier 64 and provided to a feedback circuit 66. The feedback circuit 66 determines a drive current for current generator 62 to keep the amplitude of the voltage $V_0$ constant. Marginal oscillator circuits and feedback circuits are further described in U.S. Pat. Nos. 4,000,458, and 7,112,960.

The electromagnetic induction monitoring system 40 can be used to monitor the thickness of a conductive layer, e.g., a metal layer, by inducing eddy currents in the conductive layer or generating a current in a conductive loop in the conductive layer. Alternatively, the electromagnetic induction monitoring system 40 can be used to monitor the thickness of a dielectric layer, e.g., by inducing eddy currents or current in a conductive layer or loop 100, respectively, attached to the substrate mounting surface.

If monitoring of the thickness of a conductive layer on the substrate is desired, then when the magnetic field 50 reaches the conductive layer, the magnetic field 50 can pass through and generate a current (if a conductive loop is formed in the layer) or create an eddy-current (if the conductive feature is a continuous body such a sheet). This creates an effective impedance, thus increasing the drive current required for the current generator 62 to keep the amplitude of the voltage V0 constant. The magnitude of the effective impedance depends on the thickness of the conductive layer. Thus, the drive current generated by the current generator 62 provides a measurement of the thickness of the conductive layer being polished.

As noted above, if monitoring of the thickness of a dielectric layer on the substrate is desired, then a conductive target 100 can located on the far side of the substrate 10 from the dielectric layer being polished. When the magnetic field 50 reaches the conductive target, the magnetic field 50 can pass through and generate a current (if the target is a loop) or create an eddy-current (if the target is a sheet). This creates an effective impedance, thus increasing the drive current required for the current generator 62 to keep the amplitude of the voltage $V_0$ constant. The magnitude of the effective impedance depends on the distance between the sensor 42 and the target 100, which depends on the thickness of the dielectric layer being polished. Thus, the drive current generated by the current generator 62 provides a measurement of the thickness of the dielectric layer being polished.

Other configurations are possible for the drive and sense circuitry 48. For example, separate drive and sense coils could be wound around the core, the drive coil could be driven at a constant frequency, and the amplitude or phase (relative to the driving oscillator) of the current from the sense coil could be used for the signal.

Figure 4A:
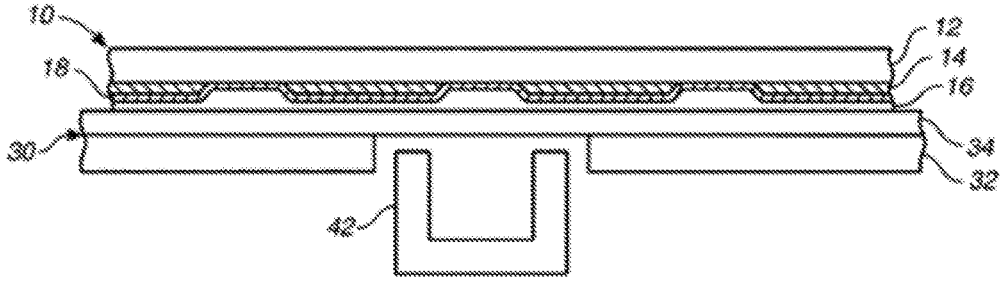
FIGS. 4A-4C schematically illustrate progression of polishing of a substrate
Figure 4B:
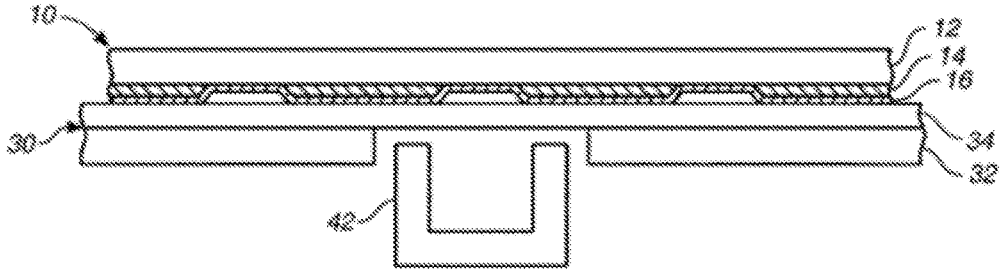
Figure 4C:
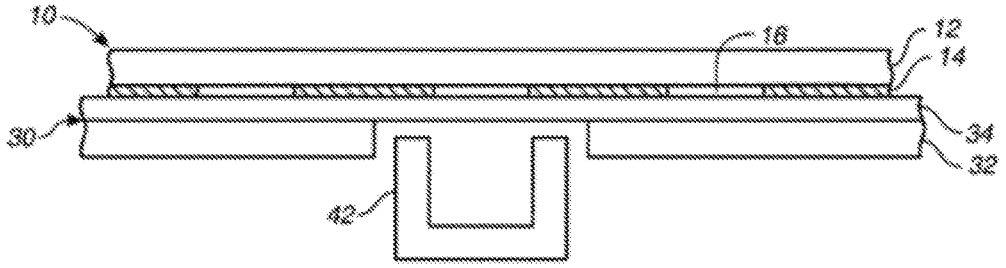
Figure 5:
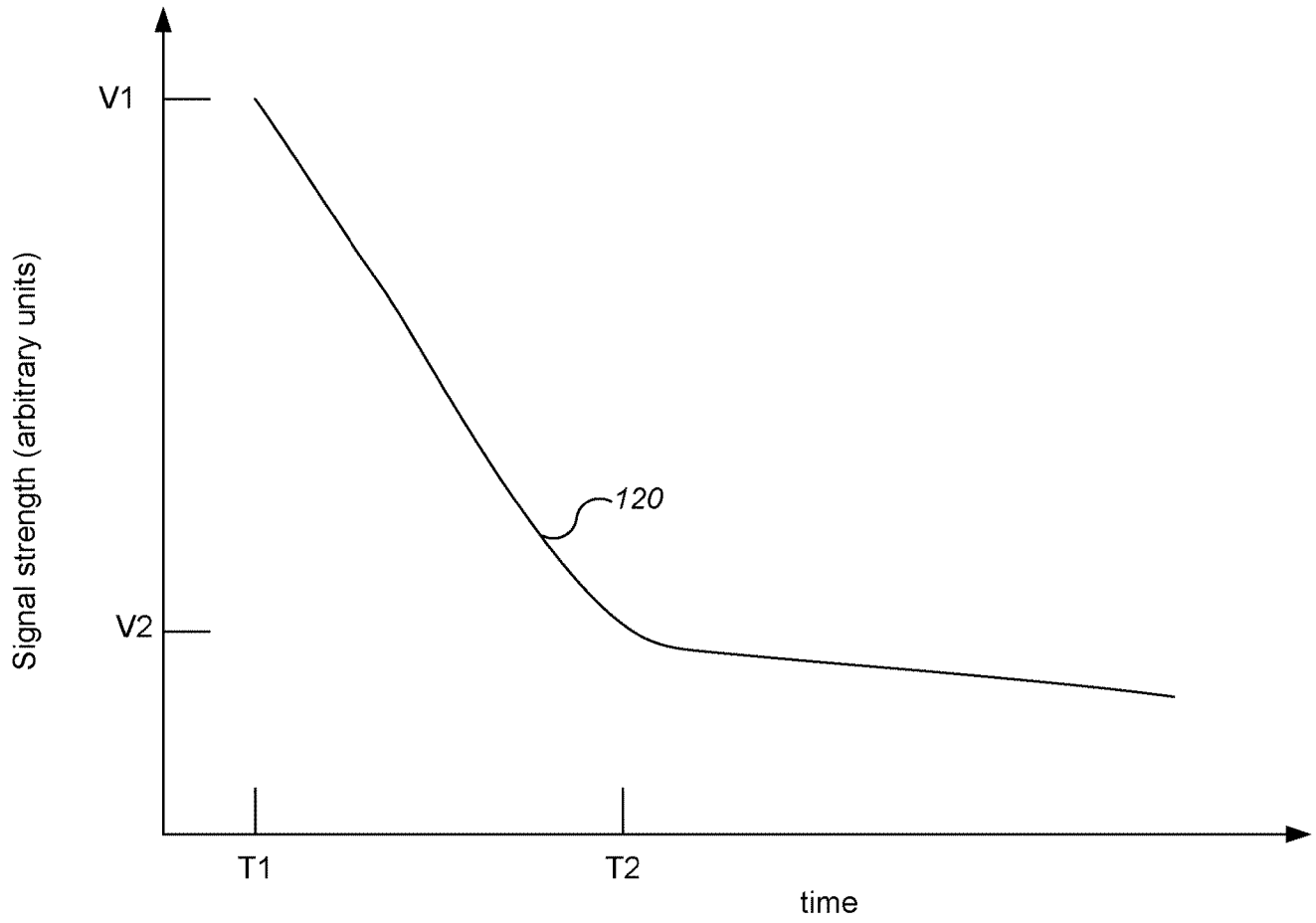
FIG. 5 is an exemplary graph illustrating an idealized signal from the electromagnetic induction monitoring system.

FIGS. 4A-4C illustrate a process of polishing a conductive layer. FIG. 5 is an exemplary graph illustrating a signal 120 from the electromagnetic induction monitoring system. The signal 120 is illustrated in FIG. 5 in an idealized form; the raw signal would include significant noise.

Initially, as shown in FIG. 4A, for a polishing operation, the substrate 10 is placed in contact with the polishing pad 30. The substrate 10 can include a silicon wafer 12 and a conductive layer 16, e.g., a metal such as copper, aluminum, cobalt, titanium, or titanium nitride disposed over one or more patterned underlying layers 14, which can be semiconductor, conductor or insulator layers. A barrier layer 18, such as tantalum or tantalum nitride, may separate the metal layer from the underlying dielectric. The patterned underlying layers 14 can include metal features, e.g., trenches, vias, pads and interconnects of copper, aluminum, or tungsten.

Since, prior to polishing, the bulk of the conductive layer 16 is initially relatively thick and continuous, it has a low resistivity, and relatively strong eddy currents can be generated in the conductive layer. The eddy currents cause the metal layer to function as an impedance source in parallel with the capacitor 60. For example, the signal can start at an initial value V1 at time T1 (see FIG. 5).

Referring to FIG. 4B, as the substrate 10 is polished the bulk portion of the conductive layer 16 is thinned. As the conductive layer 16 thins, its sheet resistivity increases, and the eddy currents in the metal layer become dampened. Consequently, the coupling between the conductive layer 16 and sensor circuitry is reduced (i.e., increasing the resistivity of the virtual impedance source). In some implementations of the sensor circuitry 48, this can cause the signal to fall from the initial value V1.

Referring to FIG. 4C, eventually the bulk portion of the conductive layer 16 is removed, leaving conductive interconnects 16' in the trenches between the patterned insulative layer 14. At this point, the coupling between the conductive portions in the substrate, which are generally small and generally non-continuous, and the signal from the sensor circuitry tends to plateau (although it may continue to fall as the trench depth is reduced). This causes a noticeable decrease in the rate of change in amplitude of the output signal from the sensor circuit. As shown in FIG. 5, this occurs at time T2 when the signal reaches value V2.

Returning to FIG. 1, if the goal is to halt polishing when the underlying layer is exposed, then the value V2 (see FIG. 5) could be used as the threshold value for endpoint detection. However, as noted above the signal from the in-situ monitoring system 40 can include noise. Therefore, a filter can be applied to the raw signal from the in-situ monitoring system 40. For example, the controller 90 can apply a filter, e.g., a notch-filter or a running-average filter to the signal received from the in-situ monitoring system 40 to generate a filtered signal. Other kinds of filters can be applied, e.g., a band-pass filter, a low-pass filter, a high-pass filter, an integrated filter, or a median filter. The filtered signal can then be used for endpoint determination.

Figure 6:
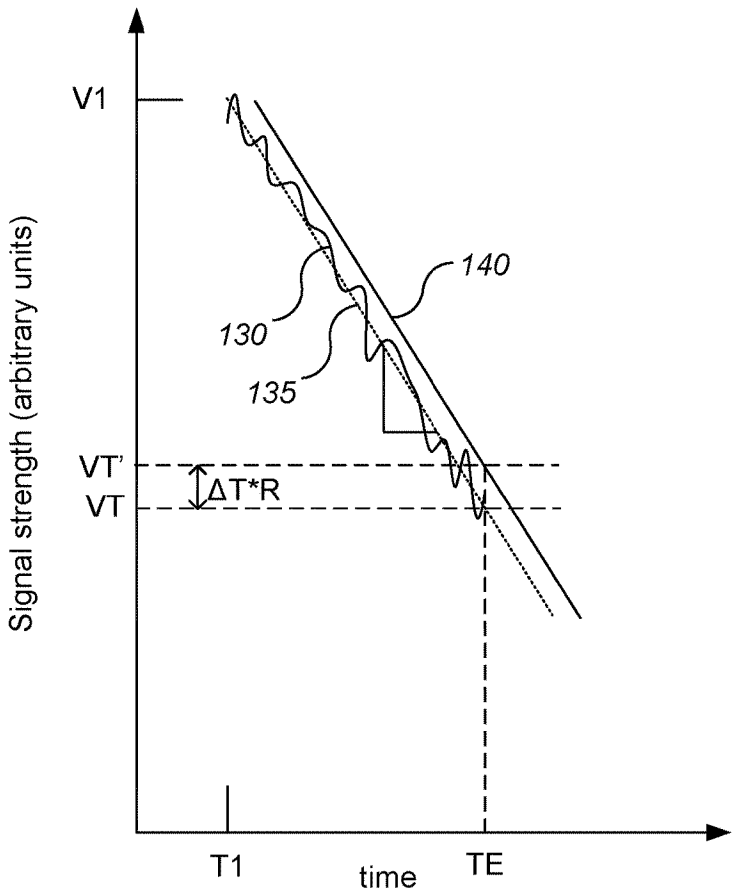
FIG. 6 is an exemplary graph illustrating a raw signal and a filtered signal from the electromagnetic induction monitoring system.

FIG. 6 is an exemplary graph illustrating signals used by the electromagnetic induction monitoring system. Referring to FIGS. 1 and 6, the sensor 42 can generate a "raw" signal 130. Although illustrated in FIG. 6 as a continuous line, in reality the raw signal 130 is a sequence of discrete values. The measurements can be acquired at a set frequency. For example, if the sensor 42 passes below the substrate 10 once per revolution of the platen 24, then the measurement frequency can be equal to the platen rotation rate.

As illustrated in FIG. 6, this signal 130 can include significant noise, so the controller 90 applies a filter the signal 130 to generate a filtered signal 140. Again, although illustrated as a continuous line, in reality the filtered signal 140 can be a sequence of discrete values, with each value in the sequence calculated from a combination of multiple values from the raw signal. In some implementations, the filtered signal 140 is generated by fitting a function, e.g., a polynomial function, e.g., a first or second order polynomial function, to the sequence of values.

As noted above, due to the need to acquire signal values after the nominal measurement time, generation of the filtered value is delayed. For example, assuming wafer asymmetry is small and measurements are taken at a regular frequency, if the filter operates by generating an output value that is a running average of five consecutive values from the raw signal, then a given output value would more accurately represent a measurement at the time of the third value from the raw signal rather than at the time of the fifth value from the raw signal. This is represented in FIG. 6 by the filtered signal 140 being shifted to the right relative to phantom line 135 (which represents a hypothetical filtered signal generated without a time offset caused by the delay).

To compensate for the time needed by the filter to acquire data, the nominal threshold value can be adjusted. In particular, the controller 90 can store a time delay value ΔT that represents the time offset generated by the filter. The controller 90 can also determine a slope R of the filtered signal 140. This slope R can represent the current polishing rate. Where VT is the original threshold (e.g., V2 from FIG. 5), an adjusted threshold VT' can be calculated as $$VT'=VT-(\Delta T*R)$$

Endpoint can then be triggered by the controller at the time TE when the filtered signal 140 crosses the adjusted threshold VT'.

Figure 7:
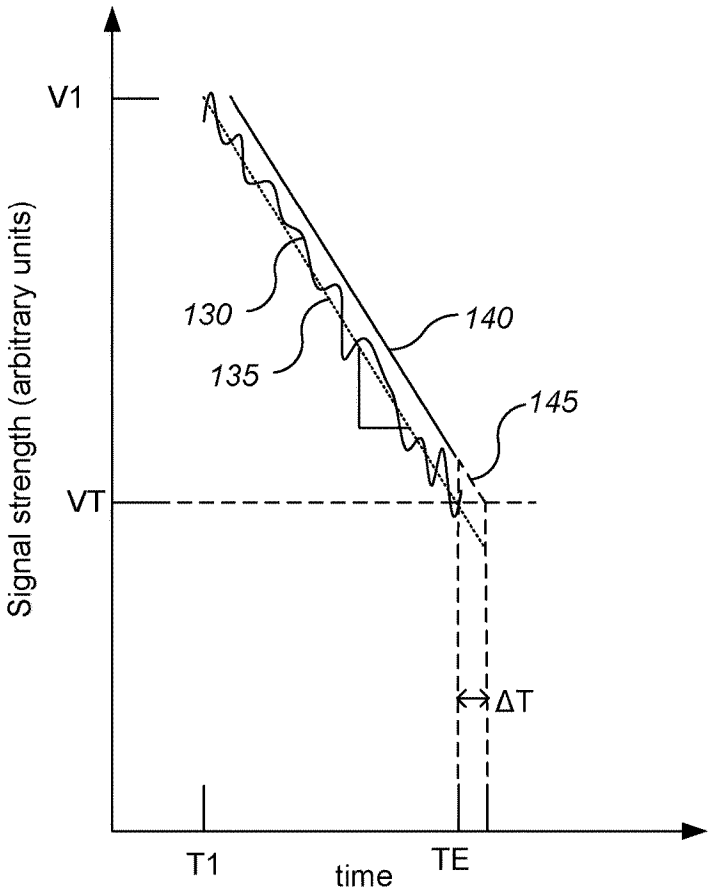
FIG. 7 is another exemplary graph illustrating a raw signal and a filtered signal from the electromagnetic induction monitoring system.

Alternatively, as shown in FIG. 7, it may be possible to project the filtered signal 140 forward by an amount of time equal to the time delay value ΔT to generate a projected signal 145. Endpoint can then be triggered by the controller at the time TE when the controller detects that the projected signal 145 crosses the threshold VT at time TE+ΔT. This is effectively equivalent to adjusting the threshold value.

In some implementations, the time delay value ΔT can be entered by a user. In some implementations, the time delay value ΔT can be calculated automatically by the controller 90 based on properties of the filter. For example, for an unweighted running average, the time delay value ΔT could be half of the time over which the raw values are averaged.

For a weighted running average, the time delay value ΔT could be similarly based on the weights. For example, a filtered value $\overline{x}_t$ could be calculated as $$\overline{x}_t = \sum_{k=0}^{N-1} a_k * x_{i-k}$$

where N is the number of consecutive values that are being averaged, and $a_k$ is the weight for value from the series. In this case, the time delay value ΔT could be calculated as $$\Delta T = \frac{1}{f} * \frac{\sum_{k=0}^{N-1} k * a_k}{\sum_{k=0}^{N-1} a_k}$$

where f is the sampling rate (e.g., the frequency at which the raw values are generated, e.g., once per rotation of the platen).

In general, the time delay value can be determined based on the measurement frequency and order of the filter, with techniques that will be appropriate for individual filters.

In some implementations, the user may input into the controller the time period over which the filter will operate; in this case, the controller 90 can calculate the time delay value ΔT from this time period (e.g., half of the time period for a unweighted running average) and can calculate the number of values to use in the filter from the sampling rate. In some implementations, the user may input into the controller the number of values to use in the filter; in this case the controller 90 can calculate the time delay value ΔT from the number of values and the sampling rate.

The techniques described above can be performed either for values that have been converted to thickness measurements, or for values that are unconverted. For example, the controller 90 can include a function, e.g., a polynomial function or a look-up table, that will output a thickness value as a function of the measured value (e.g., a voltage value or % of possible signal strength). So the signal 130 shown in FIGS. 6 and 7 could be either a sequence of thickness values generated by converting the measured values to thickness values using the function, or a sequence of measured values that depend on the thickness but are not converted to actual thickness values.

In some implementations, a slope R is calculated in the units of the measured value, and the slope R is then converted to a polishing rate in units of thickness. For example, if a polynomial function relating the thickness Y to the measurement X as $$Y=C0+C1*X+C2*X^2$$

since R=dX/dt, the polishing rate dY/dt can be calculated as $$dY/dt=R*(c1+2*c2*Y).$$

Alternatively, in some implementations, the filtered signal 140 can converted from measured values to thickness measurements for determination of the polishing rate (i.e., a function is fit to the thickness values rather than the values in the units of measurement).

In either of the above two implementations, an adjusted thickness threshold can calculated based on an original thickness target, the time delay value and the polishing rate. The adjusted thickness threshold can be used as the threshold in the thickness domain. Alternatively, the adjusted thickness threshold can converted back to an adjusted threshold in the domain of the measured values using the function and the endpoint detected in the domain of the measured values according to the time the filtered signal 140 crosses the adjusted threshold.

The computer 90 may also be connected to the pressure mechanisms that control the pressure applied by carrier head 70, to carrier head rotation motor 76 to control the carrier head rotation rate, to the platen rotation motor (not shown) to control the platen rotation rate, or to slurry distribution system 39 to control the slurry composition supplied to the polishing pad. Specifically, after sorting the measurements into radial ranges, information on the layer thickness can be fed in real-time into a closed-loop controller to periodically or continuously modify the polishing pressure profile applied by a carrier head.

The electromagnetic induction monitoring system 40 can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there can be a fluid bearing between the platen and polishing pad during polishing. The polishing pad can be a standard (e.g., polyurethane with or without fillers) rough pad, a soft pad, or a fixed-abrasive pad.

Although an endpoint control for a polishing system has been described, the techniques described above can be adapted for filtered signals from in-situ monitoring systems in other substrate processing systems that remove or deposit a layer, e.g., etching and/or chemical vapor deposition systems.

A number of embodiments have been described. Nevertheless, it will be understood that various modifications may be made without departing from the spirit and scope of the disclosure. Accordingly, other embodiments are within the scope of the following claims.

What is claimed is:

1. A polishing system, comprising:

a platen to hold a polishing pad;

a carrier head to hold a substrate against the polishing pad during polishing;

an in-situ monitoring system to monitor the substrate during polishing and generate a signal that depends on a thickness of a layer of the substrate being polished; and a controller configured to store an original threshold value and a time delay value representative of time required for filtering the signal;

receive the signal from the in-situ monitoring system and filter the signal to generate a filtered signal, determine an adjusted threshold value from the original threshold value and the time delay value, and trigger a polishing endpoint when the filtered signal crosses the adjusted threshold value.

2. The polishing system of claim 1, wherein the controller is configured to determine a slope of the filtered signal.

3. The polishing system of claim 2, wherein the controller is configured to determine an adjustment for the original threshold value by multiplying the time delay value by the slope.

4. The polishing system of claim 3, wherein the controller is configured to determine the adjusted threshold value VT' according to $$VT' = VT - (\Delta T * R)$$

where VT is the original threshold value, ΔT is the time delay value and R is the slope.

5. The polishing system of claim 1, wherein the controller is configured to filter the signal according to one or more filter parameters, and the controller is configured to determine the time delay value based on the one or more filter parameters.

6. The polishing system of claim 5, wherein the one or more filter parameters comprises a number of measurements from the signal and/or a time period of the signal to be used to generate the filtered signal.

7. The polishing system of claim 6, wherein the platen is rotatable and the in-situ monitoring system comprises a sensor positioned in the platen such that the sensor intermittently sweeps below the substrate.

8. The polishing system of claim 1, wherein the controller is configured to generated the filtered signal by applying one or more of a running average or a notch filter to the signal.

9. The polishing system of claim 1, wherein the in-situ monitoring system comprises an eddy current monitoring system.

10. The polishing system of claim 1, wherein the controller is configured to convert the signal to a sequence of thickness measurements before the filtered signal is compared to the adjusted threshold value.

11. A computer program product, comprising a non-transitory computer-readable medium having instructions to cause a processor to:

receive from an in-situ monitoring system a signal that depends on a thickness of a layer of a substrate being polished;

store an original threshold value and a time delay value representative of time required for filtering the signal;

filter the signal to generate a filtered signal;

determine an adjusted threshold value from the original threshold value and the time delay value, and trigger a polishing endpoint when the filtered signal crosses the adjusted threshold value.

12. The computer program product of claim 11, comprising instructions to determine a slope of the filtered signal.

13. The computer program product of claim 12, comprising instructions to determine an adjustment for the original threshold value by multiplying the time delay value by the slope.

14. The computer program product of claim 13, comprising instructions to determine the adjusted threshold value VT' according to $$VT' = VT - (\Delta T * R)$$

where VT is the original threshold value, ΔT is the time delay value and R is the slope.

15. The computer program product of claim 11, wherein the instructions to filter the signal comprise instructions to filter the signal according to one or more filter parameters, and comprising instructions to determine the time delay value based on the one or more filter parameters.

16. A method of polishing, comprising:

polishing a layer of a substrate;

monitoring the layer of the substrate with an in-situ monitoring system to generate a signal that depends on a thickness of the layer;

filtering the signal to generate a filtered signal;

determining an adjusted threshold value from an original threshold value and a time delay value representative of time required for filtering the signal; and triggering a polishing endpoint when the filtered signal crosses the adjusted threshold value.

17. The method of claim 16, comprising determining a slope of the filtered signal.

18. The method of claim 17, comprising determining an adjustment for the original threshold value by multiplying the time delay value by the slope.

19. The method of claim 18, comprising determining the adjusted threshold value VT' according to $$VT'=VT-(\Delta T*R)$$

where VT is the original threshold value, ΔT is the time delay value and R is the slope.

20. The method of claim 16, comprising filtering the signal according to one or more filter parameters, and determining the time delay value based on the one or more filter parameters.

* * * * *